US010585376B2

(12) United States Patent
Murayama et al.

(10) Patent No.: US 10,585,376 B2
(45) Date of Patent: Mar. 10, 2020

(54) IMAGE FORMING APPARATUS USING TEST CHART FOR ADJUSTING TRANSFER VOLTAGE

(71) Applicant: CANON KABUSHIKI KAISHA, Tokyo (JP)

(72) Inventors: Tatsuomi Murayama, Abiko (JP); Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/148,606

(22) Filed: Oct. 1, 2018

(65) Prior Publication Data

US 2019/0107797 A1 Apr. 11, 2019

(30) Foreign Application Priority Data

Oct. 5, 2017 (JP) ..... 2017-195358

(51) Int. Cl.
*G03G 15/16* (2006.01)
*G03G 15/00* (2006.01)
*G03G 15/23* (2006.01)

(52) U.S. Cl.
CPC ..... *G03G 15/1665* (2013.01); *G03G 15/1675* (2013.01); *G03G 15/234* (2013.01); *G03G 15/5062* (2013.01); *G03G 15/5058* (2013.01); *G03G 15/55* (2013.01)

(58) Field of Classification Search
CPC ..... G03G 15/1665; G03G 15/1675; G03G 15/5062; G03G 15/234; G03G 15/55; G03G 15/5058
See application file for complete search history.

(56) References Cited

U.S. PATENT DOCUMENTS

| | | | | |
|---|---|---|---|---|
| 7,251,442 | B2 | 7/2007 | Sato et al. | |
| 8,843,003 | B2 | 9/2014 | Nakao | |
| 2013/0039673 | A1* | 2/2013 | Nakao | G03G 15/234 399/49 |

FOREIGN PATENT DOCUMENTS

| | | | |
|---|---|---|---|
| JP | 10-207149 | A | 8/1998 |
| JP | 2000-221803 | A | 8/2000 |
| JP | 2006-078630 | A | 3/2006 |
| JP | 2013-037185 | A | 2/2013 |

* cited by examiner

*Primary Examiner* — G. M. A Hyder
(74) *Attorney, Agent, or Firm* — Venable LLP

(57) ABSTRACT

An image forming apparatus includes a controller configured to control a first and a second voltage applied to a transfer device when transferring an image to a first and a second side of a recording material, respectively. The controller controls a mode that outputs a test chart on which at least one of a plurality of first test images for adjusting the first voltage and a plurality of second test images for adjusting the second voltage is formed. In a case of forming the second test images on a second side of the test chart, and before forming the second test images, the controller forms a plurality of predetermined toner images under a same image forming condition on a first side of the test chart so that the predetermined toner images are formed on a plurality of predetermined areas overlapping each area where the second test images are to be formed.

7 Claims, 12 Drawing Sheets

IMAGE FORMING APPARATUS USING TEST CHART FOR ADJUSTING TRANSFER VOLTAGE

BACKGROUND OF THE INVENTION

Field of the Invention

The present invention relates to an image forming apparatus that forms an image on a recording material by an electrophotographic method, an electrostatic recording method or the like.

Description of the Related Art

Conventionally, image forming apparatuses of an electrophotographic method have been widely applied as a copying machine, a printer, a plotter, a facsimile machine, a multifunctional printer having a plurality of functions thereof, and the like. The electrophotographic method mainly has steps of exposure, development, transfer and fixation. In exposure, a charged photosensitive member is irradiated with laser light to form an electrostatic latent image thereon. In development, the electrostatic latent image is developed by a toner, and in transfer, the developed toner image is transferred onto a recording material. In fixation, the toner image transferred onto the recording material is heated and fixed. In the image forming apparatus like this, an optimal value of a transfer current may differ from a set value in the use environment due to a change in the use environment of the apparatus main body and a change of the apparatus main body with use for a long period, and in that case, it is feared that favorable transfer cannot be obtained, and a poor image, an insufficient density and the like occur.

In order to solve the above, there is developed an image forming apparatus that generates a test chart in which a test pattern that is a set of a plurality of patch images with transfer conditions changed is printed on a recording material (refer to Japanese Patent Application Laid-Open No. 2000-221803). In this image forming apparatus, the test pattern is printed on the recording material by the patch images in which a transfer current for transferring a toner image to the recording material is changed stepwise, after which, the image reading portion is caused to read the generated test chart, and the density is acquired. Subsequently, setting of the transfer current is fed back based on the obtained density, and thereby stability of image quality is enhanced.

Further, in recent years, an image forming apparatus having a double-sided printing function of performing image formation on a front side (first side) and a back side (second side) of a sheet of recording material has been widespread. In the image forming apparatus having the double-sided printing function like this, an image forming apparatus that feeds back transfer conditions concerning respective sides of a front and a back of the recording material has been developed (refer to Japanese Patent Application Laid-Open No. 2013-37185). In the image forming apparatus, a test chart is generated by printing the test pattern by patch images on the respective sides of the front and back of the recording material, after which, the density and chromaticity of the generated test chart are read, and based on the obtained image information, the respective transfer conditions of the front and back are fed back. Further, in the image forming apparatus, on the front side and the back side of one test chart, an area where the test patterns overlap one another and an area where the test patterns do not overlap one another are made, and based on the result of reading the test patterns in the respective areas, the transfer voltage is set in response to presence or absence of the test pattern on the front side.

However, in the image forming apparatus described in Japanese Patent Application Laid-Open No. 2013-37185 described above, the area where the test pattern on the front side and the test pattern on the back side overlap one another and the area where the test pattern on the front side and the test pattern on the back side do not overlap one another are formed in one test chart, so that there is the possibility that the following thing occurs. That is, the test pattern on the front side which is formed earlier has resistance electrically, so that in the area overlapping the test pattern on the front side and the area that does not overlap the test pattern on the front side, the transfer voltages change by the allotted voltage by the resistance of the test pattern on the front side. Consequently, in the test pattern on the back side, the density may be different between the area that overlaps the test pattern on the front side and the area that does not overlap the test pattern on the front side.

That is, since the transfer condition is changed in accordance with the individual patch images when the test pattern on the front side is formed, the toner transferred mass per unit area varies depending on the difference in transfer conditions, so that the resistance value also varies depending on the area of the recording material. Consequently, when the test pattern is formed on the back side of the test chart where a plurality of test patterns having different transfer conditions are formed on the front side, the transfer condition changes depending on the area, in the areas overlapping the test pattern on the front side, and the toner transferred mass per unit area on the back side changes. Thereby, the toner transferred mass per unit area of the test pattern on the back side receives influence of not only the change in the transfer setting on the back side but also change of the toner transferred mass per unit area of the test pattern on the front side, so that it is feared that precision at the time of setting the transfer condition based on the density of the test pattern on the back side is reduced.

With the problem as above taken into consideration, it is also conceivable to form no test pattern on the front side of the test chart. However, from the viewpoint of consumption of paper, it is preferable to form the test patterns on both sides of the test chart. Further, from the viewpoint of adjusting the transfer condition on the back side in the state close to a time of normal image formation, it is preferable to perform adjustment so as to be able to ensure transferability on the back side even in the state where a toner image is formed on the front side.

SUMMARY OF THE INVENTION

The present invention provides an image forming apparatus configured to restrain setting precision of a transfer condition of a second side from being reduced by an influence of a toner image that is formed on a first side of a recording material, in the image forming apparatus configured to adjust the transfer condition of the second side by a test pattern formed on the second side of the recording material.

According to an embodiment, an image forming apparatus comprises:

an image bearing member configured to bear a toner image;

a toner image forming portion configured to form the toner image on the image bearing member;

a transfer device configured to transfer the toner image borne on the image bearing member to a recording material;

a power source configured to apply a transfer voltage to the transfer device; and a controller configured to control a first transfer voltage that is applied to the transfer device when transferring an image to a first side of the recording material and a second transfer voltage that is applied to the transfer device when transferring an image to a second side of the recording material, wherein the controller is configured to perform a mode that outputs a test chart on which at least one of a plurality of first test images for adjusting the first transfer voltage and a plurality of second test images for adjusting the second transfer voltage is formed, and wherein in a case where the controller forms the second test images on a second side of the test chart in the mode, before forming the second test images, the controller forms a plurality of predetermined toner images under a same image forming condition on a first side of the test chart so that the predetermined toner images are formed on a plurality of predetermined areas overlapping each area where the second test images to be formed.

According to another embodiment, an image forming apparatus comprises:

an image bearing member configured to move while bearing a toner image;

a toner image forming portion configured to form the toner image on the image bearing member;

a transfer device configured to transfer the toner image borne on the image bearing member to a recording material;

a power source configured to apply a transfer voltage to the transfer device; and a controller configured to control a first transfer voltage that is applied to the transfer device when transferring an image to a first side of the recording material and a second transfer voltage that is applied to the transfer device when transferring an image to a second side of the recording material, wherein the controller is configured to perform a mode that outputs a test chart, wherein a plurality of first test images for adjusting the first transfer voltage are formed on a first side of the test chart and a plurality of second test images for adjusting the second transfer voltage are formed on a second side of the test chart, and wherein in the mode, the controller forms the first test images and the second test images so that the first and second test images do not overlap each other with respect to a thickness direction of the test chart.

Further features of the present invention will become apparent from the following description of exemplary embodiments with reference to the attached drawings.

DESCRIPTION OF THE EMBODIMENTS

First Embodiment

Hereinafter, a first embodiment of the present invention will be described in detail with reference to FIGS. 1 to 10. In the present embodiment, a tandem type full-color printer is described as an example of an image forming apparatus 1. However, the present invention is not limited to the tandem type image forming apparatus 1, but may be another type of image forming apparatus, and the present invention is not limited to a full-color printer, but may be a monochrome or mono-color printer. Alternatively, the present invention can be carried out for various purposes, such as a printer, various printing machines, a copying machine, a facsimile machine, and a multifunctional printer.

Figure 1:
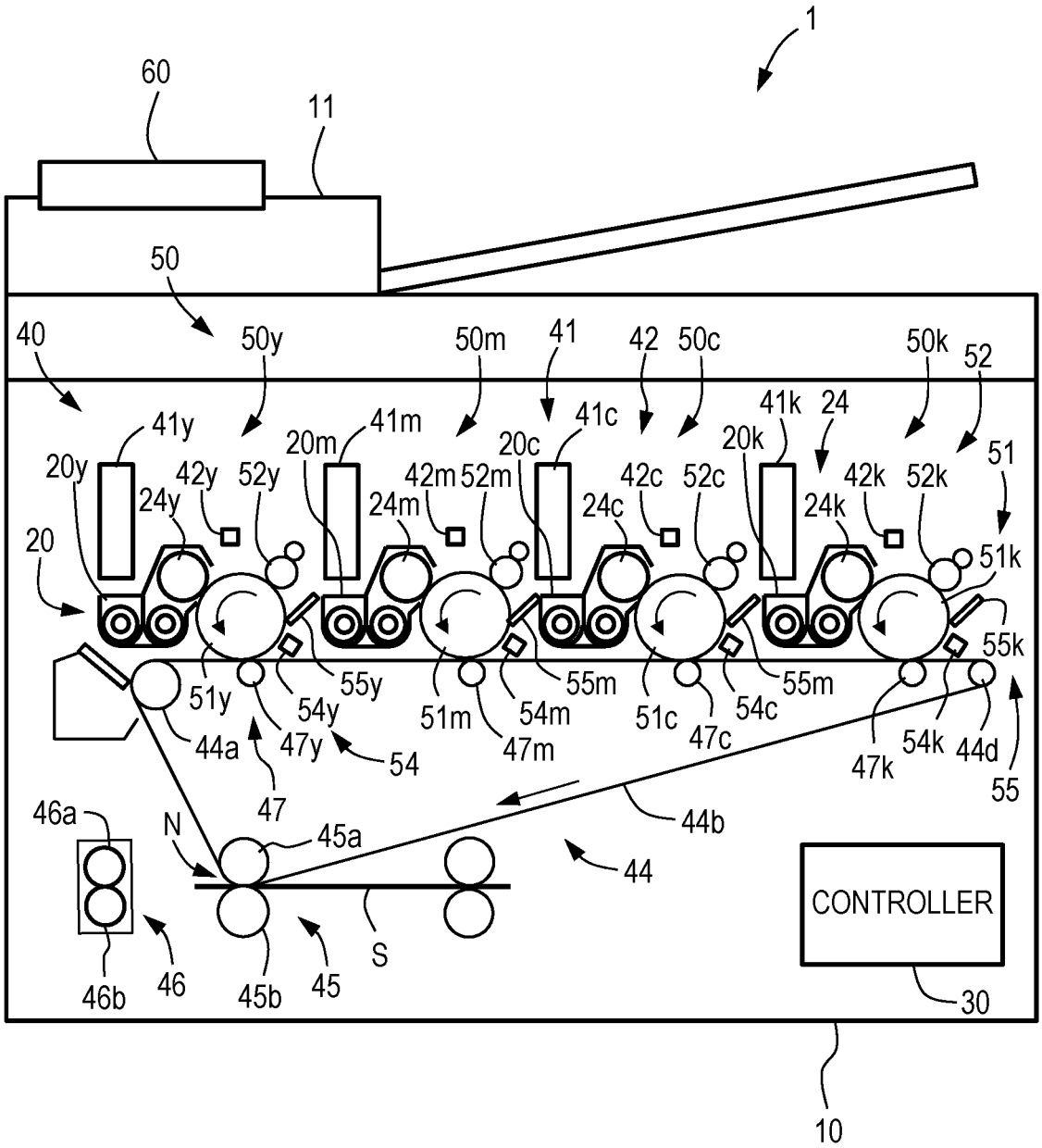
FIG. 1 is a sectional view illustrating a schematic configuration of an image forming apparatus according to a first embodiment.

As illustrated in FIG. 1, the image forming apparatus 1 includes an apparatus main body 10, a sheet feeding portion (not illustrated), an image forming portion 40, a sheet discharge portion (not illustrated), a controller 30 and an operating portion 60. Inside the apparatus main body 10, a temperature and humidity sensor 70 (refer to FIG. 2) capable of detecting a temperature and humidity as internal environmental information is provided. The image forming apparatus 1 can form a full-color image of four colors on a recording material in response to an image signal from an original reading apparatus (density acquiring portion) 11, a host apparatus such as a personal computer, or an external apparatus such as a digital camera or a smartphone. The original reading apparatus 11 images reflected light of light irradiated to an original placed on a platen by a light source on a CCD sensor via an optical system, and detects the image as image information. Note that a sheet S which is the recording material is a sheet on which a toner image is formed, and as specific examples, there are cited ordinary paper, a synthetic resin sheet which is a substitute for ordinary paper, thick paper, a sheet for an overhead projector, and the like.

The image forming portion 40 can form an image based on image information onto a sheet S that is fed from the sheet feeding portion. The image forming portion 40 includes image forming units 50*y*, 50*m*, 50*c* and 50*k*, toner bottles 41*y*, 41*m*, 41*c* and 41*k*, exposure apparatuses 42*y*, 42*m*, 42*c* and 42*k*, an intermediate transfer unit 44, a secondary transfer portion 45 and a fixing portion 46. Note that the image forming apparatus 1 of the present embodiment corresponds to the full-color, and the image forming units 50*y*, 50*m*, 50*c* and 50*k* are separately provided with same configurations for respective four colors of yellow (y), magenta (m), cyan (c) and black (k). Consequently, in FIG. 1, respective configurations of four colors are denoted by the same reference signs followed by color identifiers, but in the description, the respective configurations may be denoted by only the reference signs without being followed by the color identifiers.

The image forming unit (toner image forming unit) 50 has a photosensitive drum 51 that bears a toner image and moves, a charging roller 52, a developing apparatus 20, a pre-exposure apparatus 54 and a cleaning blade 55. The image forming unit 50 is integrally unitized as a process cartridge, is configured to be attachable to and detachable from the apparatus main body 10, and forms a toner image on an intermediate transfer belt 44*b* that will be described later. Note that in the present embodiment, a negatively charged toner of an average particle diameter of 5.5 μm is used as a toner, and as a carrier, a magnetic carrier of an average particle diameter of 35 μm with saturation magnetization of 0.205 $Am^2/m^3$ is used. Further, what is obtained by mixing the toner and carrier with a weight ratio of 6:94 is used as a developer.

The photosensitive drum 51 is rotatable, and bears an electrostatic image that is used in image formation. The photosensitive drum 51 is an organic photoconductor (OPC) of an outside diameter of 30 mm with negative chargeability, and is rotationally driven by a motor (not illustrated) in an arrow direction at a predetermined process speed (circumferential velocity) in the present embodiment. The photosensitive drum 51 has an aluminum cylinder as a substrate, and has three layers that are an undercoat layer, a photoelectric charge generation layer, and a charge transport layer that are sequentially coated and stacked, as surface layers on a surface of the aluminum cylinder.

The charging roller 52 uses a rubber roller that contacts the surface of the photosensitive drum 51, and follows and rotates, and uniformly charges the surface of the photosensitive drum 51. To the charging roller 52, a charging bias power source 71 (refer to FIG. 2) is connected. The charging bias power source 71 applies a DC voltage to the charging roller 52 as a charging bias, and charges the photosensitive drum 51 via the charging roller 52.

The exposure apparatus 42 is a laser scanner, and emits laser light in accordance with information on an image of a separation color that is output from the controller 30. An electrostatic latent image that is formed by the exposure apparatus 42 is an aggregate of small dot images, and by changing a density of the dot images, a density of the toner image that is formed on the photosensitive drum 51 can be changed. In the present embodiment, maximum densities of the toner images of the respective colors are approximately 1.5 to 1.7, and the transferred mass per unit area of the toner at the time of the maximum density is approximately 0.4 to 0.6 $mg/cm^2$.

The developing apparatus 20 develops the electrostatic image formed on the photosensitive drum 51 by a toner, by a developing bias being applied to the developing apparatus 20. The developing apparatus 20 has a developing sleeve 24. The developing apparatus 20 houses a developer supplied from the toner bottle 41, and develops the electrostatic image formed on the photosensitive drum 51. The developing sleeve 24 is formed of a nonmagnetic material such as an aluminum and a nonmagnetic stainless steel, for example, and is made of an aluminum in the present embodiment. Inside the developing sleeve 24, a roller-shaped magnet roller is fixedly installed in a non-rotating state to a developing container. The developing sleeve 24 bears a developer having a nonmagnetic toner and a magnetic carrier, and conveys the developer to a developing area facing the photosensitive drum 51. A developing bias power source 72 (refer to FIG. 2) is connected to the developing sleeve 24. The developing bias power source 72 applies a DC voltage to the developing sleeve 24 as a developing bias, and develops the electrostatic image formed on the photosensitive drum 51.

The toner image which is developed on the photosensitive drum 51 is primarily transferred to the intermediate transfer unit 44. The photosensitive drum 51 after primary transfer has electricity removed from the surface by the pre-exposure apparatus 54. The cleaning blade 55 is of a counter blade type, and is caused to abut on the photosensitive drum 51 with a predetermined pressing force. After the primary transfer, the toner remaining on the photosensitive drum 51 without being transferred to the intermediate transfer unit 44 is removed by the cleaning blade 55 which is provided to abut on the photosensitive drum 51, and the photosensitive drum 51 is prepared for a next image forming step.

The intermediate transfer unit 44 includes a plurality of rollers such as a drive roller 44*a*, a driven roller 44*d*, and primary transfer rollers 47*y*, 47*m*, 47*c* and 47*k*, and an intermediate transfer belt (image bearing member) 44*b* that is wound on these rollers, and bears the toner image to move. The driven roller 44*d* is a tension roller to control a tension of the intermediate transfer belt 44*b* to be constant. A force to push out the intermediate transfer belt 44*b* to a surface side is applied to the driven roller 44*d* by an urging force of an urging spring (not illustrated), and by the force, tension of approximately 2 to 5 kg is exerted in a conveying direction of the intermediate transfer belt 44*b*. The primary transfer rollers 47*y*, 47*m*, 47*c* and 47*k* are respectively disposed to face the photosensitive drums 51*y*, 51*m*, 51*c* and 51*k*, abut on the intermediate transfer belt 44*b*, and primarily transfer the toner image on the photosensitive drum 51 to the intermediate transfer belt 44*b*. A primary transfer bias power source 73 (refer to FIG. 2) is connected to the primary transfer roller 47.

The intermediate transfer belt 44*b* is configured to rotate at 150 mm/sec in an arrow direction. The intermediate transfer belt 44*b* abuts on the photosensitive drum 51 and forms a primary transfer portion between the intermediate transfer belt 44*b* and the photosensitive drum 51, and a primary transfer bias is applied from the primary transfer bias power source 73, whereby the toner image formed on the photosensitive drum 51 is primarily transferred in the primary transfer portion. The primary transfer bias with positive polarity is applied to the intermediate transfer belt 44*b* by the primary transfer roller 47, and thereby toner images having respective negative polarities on the photosensitive drum 51 are sequentially transferred onto the intermediate transfer belt 44*b* in a multiplex manner.

The intermediate transfer belt 44*b* is an endless belt having a three-layer structure of a resin layer, an elastic layer and a surface layer from a back surface side. As a resin material that composes the resin layer, a material such as a polyimide and a polycarbonate is used, and a thickness of the resin layer is 70 to 100 μm. As an elastic material composing the elastic layer, a material such as a urethane rubber and a chloroprene rubber is used, and a thickness of the elastic layer is 200 to 250 μm. As a material composing the surface layer, a material is desired, which decreases an adhesive force of a toner to the surface of the intermediate transfer belt 44*b* and makes it easy for the toner to be transferred to the sheet S in a nip portion N of secondary transfer. In the present embodiment, for the surface layer, for example, one kind of resin material such as a polyurethane, a polyester or an epoxy resin, or two or more kinds of materials of an elastic rubber, an elastomer, and a butyl rubber is or are used as a base material. Subsequently, to the base material, for example, one kind or two kinds or more of powder or particles of fluororesin or the like, or powder or particles with different particle diameters are dispersed as the material that decreases surface energy to enhance a lubricating ability, and thereby the surface layer is formed. Note that a thickness of the surface layer is 5 to 10 μm. A conductive agent for resistance value adjustment such as carbon black is added to the intermediate transfer belt 44*b*, and a volume resistivity is $1\times10^{9}$ to $1\times10^{14}$ Ω·cm.

The secondary transfer portion 45 includes a secondary transfer inner roller 45*a* and a secondary transfer outer roller (transfer unit) 45*b*. The secondary transfer inner roller 45*a* is disposed to face the secondary transfer outer roller 45*b* via the intermediate transfer belt 44*b*. A secondary transfer bias power source (power source) 74 (refer to FIG. 2) is connected to the secondary transfer outer roller 45*b*. The secondary transfer bias power source 74 applies a DC voltage to the secondary transfer outer roller 45*b* as a secondary transfer bias (transfer voltage). The secondary transfer outer roller 45*b* abuts on the intermediate transfer belt 44*b*, and a secondary transfer bias with reversed polarity from the toner is applied in the nip portion N with the intermediate transfer belt 44*b*. Thereby, the secondary transfer outer roller 45*b* collectively secondarily transfers a toner image carried by the intermediate transfer belt 44*b* onto a sheet S that is supplied to the nip portion N. Note that the image forming apparatus 1 of the present embodiment is capable of both-sided printing on a first side and a second side at a back side of the first side of the single sheet S as will be described later, and the secondary transfer outer roller 45*b* is capable of transferring the toner image borne by the intermediate transfer belt 44*b* onto the first side and the second side of the sheet S. A core metal of the secondary transfer inner roller 45*a* is connected to a ground potential. In the present embodiment, the secondary transfer bias is set so that a current of, for example, +40 to 60 μA flows into the nip portion N.

The secondary transfer outer roller 45*b* has an outside diameter of 24 mm, for example, and has an elastic layer of an ion conductive foamed rubber (NBR rubber) and a core metal. As the secondary transfer outer roller 45*b*, a roller with roller surface roughness Rz=6.0 to 12.0 μm, a resistance value of $1\times10^{5}$ to $1\times10^{7}$Ω (N/N (23° C., 50% RH) measurement, 2 kV applied), and hardness of the elastic layer of approximately 30 to 40 (Asker-C hardness) is used.

The fixing portion 46 includes a fixing roller 46*a* and a pressing roller 46*b*. The sheet S is clamped and conveyed between the fixing roller 46*a* and the pressing roller 46*b*, and thereby the toner image transferred onto the sheet S is heated and pressed to be fixed to the sheet S. The sheet discharge portion feeds the sheet S which is conveyed from a discharge route after fixation, and for example, discharges the sheet S from a discharge port and stacks the sheet S on a discharge tray. Further, a reversing and conveying path (not illustrated) that can turn over the sheet after fixation, and allows the sheet to pass through the secondary transfer portion 45 again is provided between the fixing portion 46 and the discharge port. By operation of the reversing and conveying path, image formation can be realized on both sides of one sheet.

Figure 2:
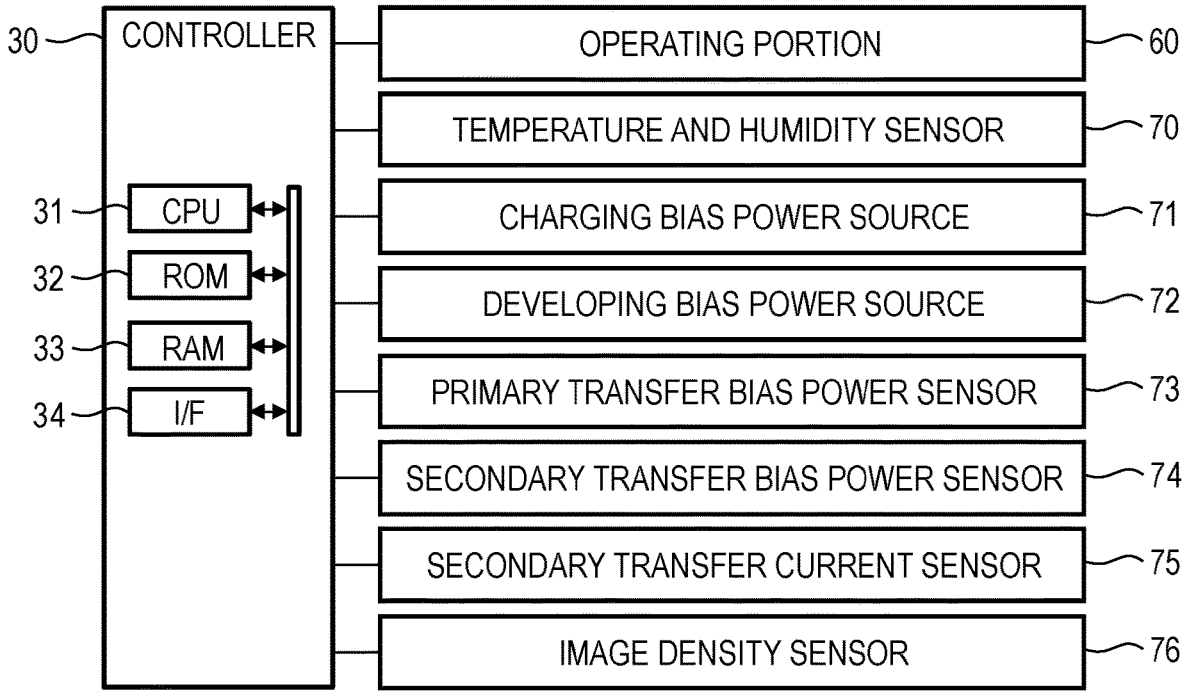
FIG. 2 is a block diagram illustrating a schematic configuration of a control system of the image forming apparatus according to the first embodiment.

As illustrated in FIG. 2, the controller 30 is configured by a computer, and includes, for example, a CPU 31, a ROM 32 that stores programs that control respective portions, a RAM 33 that temporarily stores data, and an input and output circuit (I/F) 34 that inputs and outputs signals to and from an outside. The CPU 31 is a microprocessor that governs entire control of the image forming apparatus 1, and is a nucleus of a system controller. The CPU 31 is connected to a sheet feeding portion, the image forming portion 40, the sheet discharge portion and the operating portion 60 and exchanges signals with the respective portions and controls operations, via the input and output circuit 34. An image formation control sequence or the like for forming an image on the sheet S is stored in the ROM 32. The charging bias power source 71, the developing bias power source 72, the primary transfer bias power source 73 and the secondary transfer bias power source 74 are connected to the controller 30, and are respectively controlled by signals from the controller 30. Further, a secondary transfer current sensor 75, a temperature and humidity sensor 70, and an image density sensor 76 are connected to the controller 30, and signals detected in the respective sensors are input to the controller 30. The user can execute a print job by operating the operating portion 60, and the controller 30 operates various devices of the image forming apparatus 1 by receiving signals from the operating portion 60. Note that the operating portion 60 can adjust and set a secondary transfer bias by an operation of the user. The operating portion 60 can change a first secondary transfer bias and a second secondary transfer bias that will be described later.

In the present embodiment, a video controller (not illustrated) is connected to the controller 30. The video controller converts an image information signal from an external apparatus that is communicably connected to an original reading apparatus 11 or the apparatus main body 10 into a signal relating to image formation in the image forming apparatus 1. The CPU 31 controls operations of the respective portions of the image forming apparatus 1, based on the signal relating to image formation from the video controller. Thereby, the image forming apparatus 1 can form and output a recorded image. Further, the video controller is loaded with a test pattern generating portion that generates an image information signal of a patch image that is a toner image for adjustment. The CPU 31 controls the respective portions of the image forming apparatus 1 to form a patch image corresponding to a signal from the test pattern generating portion based on the control program stored in the ROM 32 or the like. Note that the test pattern generating portion may be provided outside the video controller.

The controller 30 can execute a both-side mode in which a toner image borne by the intermediate transfer belt 44*b* is transferred onto a first side of the sheet S, and thereafter, the toner image borne by the intermediate transfer belt 44*b* is transferred onto a second side of the same sheet S. The controller 30 can execute a test chart output mode that outputs test charts Tc1 (refer to FIG. 6) and Tc2 (refer to FIG. 7). On the test charts Tc1 and Tc2, at least one of a first test pattern 101 (refer to FIG. 6) and a second test pattern 102 (refer to FIG. 7) is formed. The first test pattern 101 is a test pattern for adjusting the first secondary transfer bias (first transfer voltage) that is set at a time of transferring an image on a first side S1 of the sheet S. The second test pattern 102 is a test pattern for adjusting the second secondary transfer bias (second transfer voltage) that is set at the time of transferring an image on a second side S2 of the sheet S. When the controller 30 outputs the second test pattern 102, the controller 30 forms a solid image (predetermined toner image) 103 on the first side S1 of the test chart Tc1, and thereafter, forms the second test pattern 102 on the second side S2 of the test chart Tc2.

Figure 6:
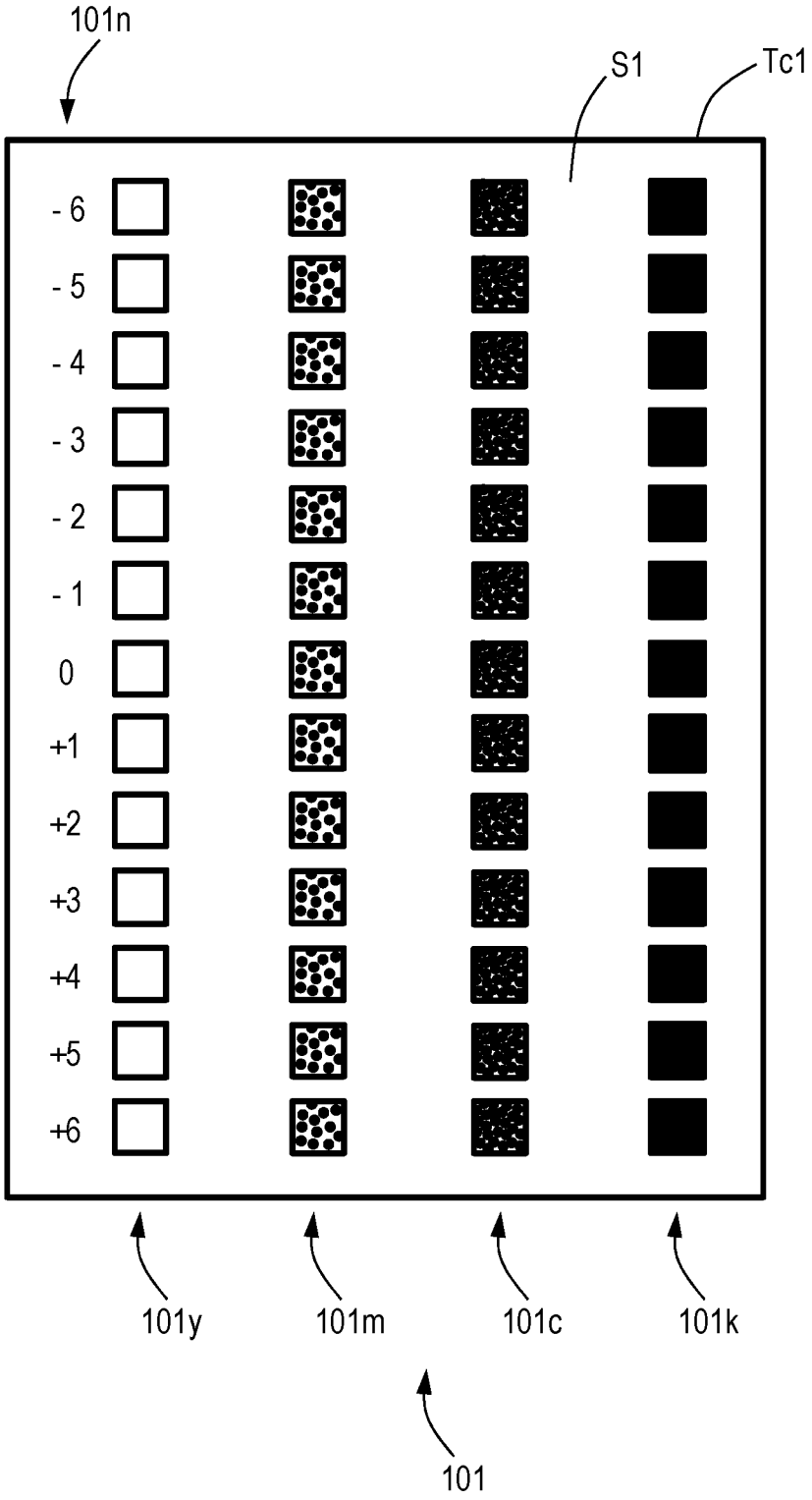
FIG. 6 is an explanatory view illustrating a first test chart having a first test pattern formed by the image forming apparatus according to the first embodiment on the first side.
Figure 7:
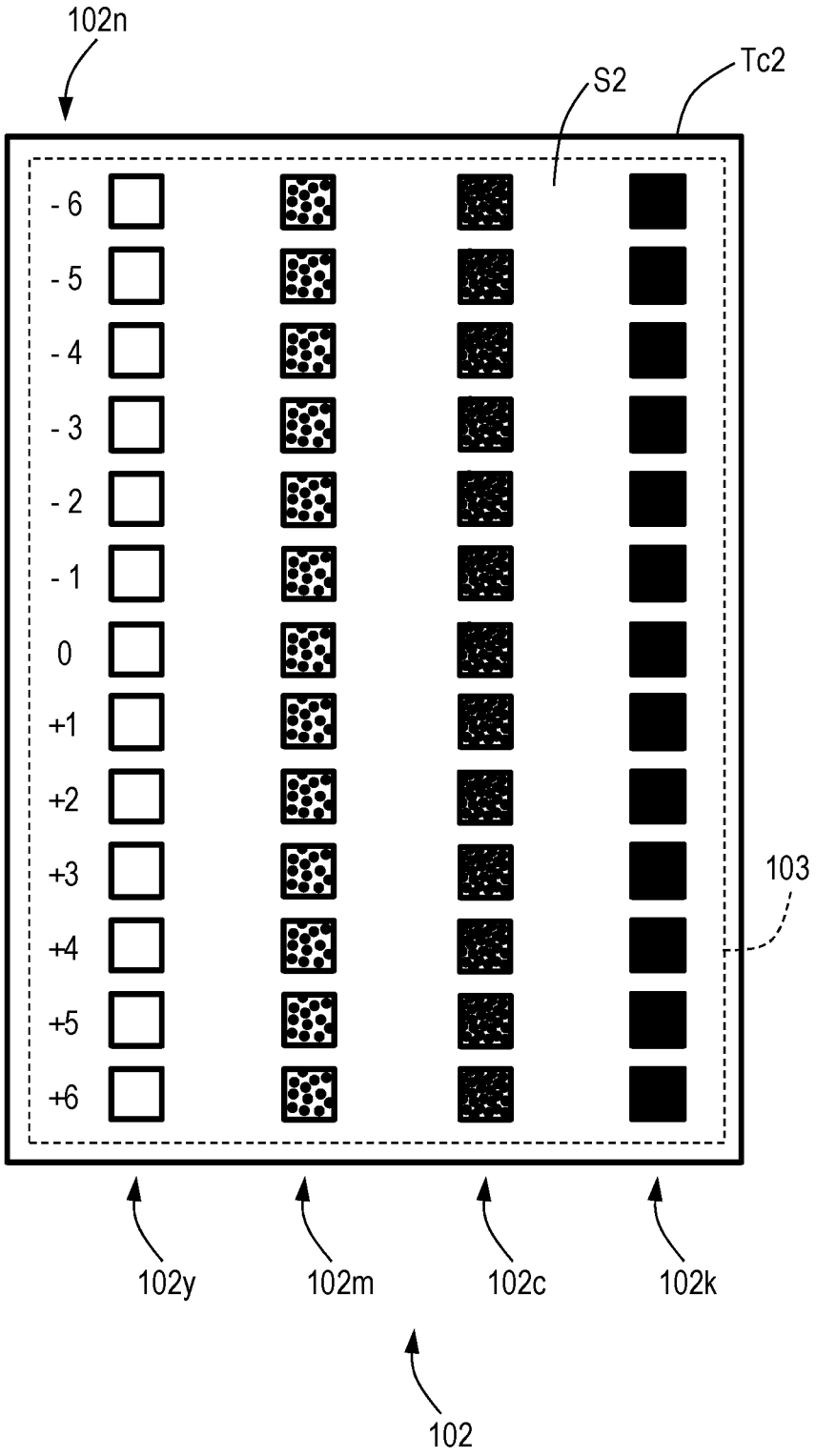
FIG. 7 is an explanatory view illustrating a second test chart having a second test pattern formed by the image forming apparatus according to the first embodiment on the second side.

The test chart is enabled to include the first test chart Tc1 on which the first test pattern 101 is formed, and the second test chart Tc2 on which the second test pattern 102 is formed (refer to FIG. 6 and FIG. 7). In this case, the controller 30 can output the second test chart Tc2 after outputting the first test chart Tc1 in a test chart output mode. Further, the controller 30 can change the first secondary transfer bias which is applied to the secondary transfer outer roller 45*b* at the time of transferring the solid image 103 in the test chart output mode.

Next, an image forming operation in the image forming apparatus 1 configured in this way will be described.

When the image forming operation is started, the photosensitive drum 51 rotates first and the surface is charged by the charging roller 52. Subsequently, laser light is emitted to the photosensitive drum 51 based on the image information by the exposure apparatus 42, and an electrostatic latent image is formed on the surface of the photosensitive drum 51. The toner adheres to the electrostatic latent image, whereby the image is developed to be visualized as a toner image, and is transferred to the intermediate transfer belt 44*b*.

The sheet S is supplied in parallel with the forming operation of the toner image like this, and the sheet S is conveyed to the secondary transfer portion 45 via the conveying path in accordance with the timing of the toner image on the intermediate transfer belt 44*b*. Further, the image is transferred to the sheet S from the intermediate transfer belt 44*b*, the sheet S is conveyed to the fixing portion 46, where the unfixed toner image is heated and pressed to be fixed to the surface of the sheet S, and the sheet S is discharged from the apparatus main body 10.

Next, a method for determining the set voltage of the secondary transfer portion 45 at the time of the image forming will be described. A proper secondary transfer electric field changes in accordance with an atmosphere environment and the kind of the sheet S. Therefore, in the present embodiment, in order to optimize the secondary transfer electric field for transferring the toner image on the sheet S, ATVC (Active Transfer Voltage Control) is adopted as an adjustment step for secondary transfer. The ATVC is executed at the time of non-secondary transfer before the secondary transfer step of transferring the toner image onto the sheet S by the controller 30. ATVC as the adjustment step is performed by measuring an electric current flowing in the secondary transfer portion 45 using the secondary transfer current sensor 75 when an adjustment voltage is applied, after the secondary transfer bias power source 74 applies a plurality of adjustment voltages that are subjected to constant voltage control. A correlation between the voltage and the current can be calculated based on the adjustment voltage and the detected current, by ATVC. Further, based on the calculated correlation between the current and the voltage, a voltage Vb for passing a secondary transfer target current Itag that is needed for secondary transfer is calculated. A voltage (Vb+Vp) obtained by adding a recording material allotment voltage Vp to Vb for passing the secondary transfer target current Itag is set as a set voltage Vtr of the secondary transfer bias subjected to constant voltage control, during the secondary transfer step following the adjustment step. As a result, in accordance with the atmosphere environment and the sheet thickness, a proper voltage value is set. Further, since the secondary transfer bias is applied in the state subjected to constant voltage control during the secondary transfer, the secondary transfer is performed in a stable state even when the width of the sheet S is changed.

Here, a method for setting a proper secondary bias by generating a test chart by printing a test pattern having a stepwise density on a sheet, and determining the proper secondary transfer bias based on a toner transferred mass per unit area thereof will be described. In this case, a case is conceivable, in which when setting of the secondary transfer biases on the first side and the second side of the sheet is performed, setting is carried out on the front and the back of one sheet during a series of both-side job from a viewpoint of downtime. At this time, the first test pattern formed on the first side and the second test pattern formed on the second side may overlap each other on the front and the back depending on a size, and writing positions of images.

Figure 3:
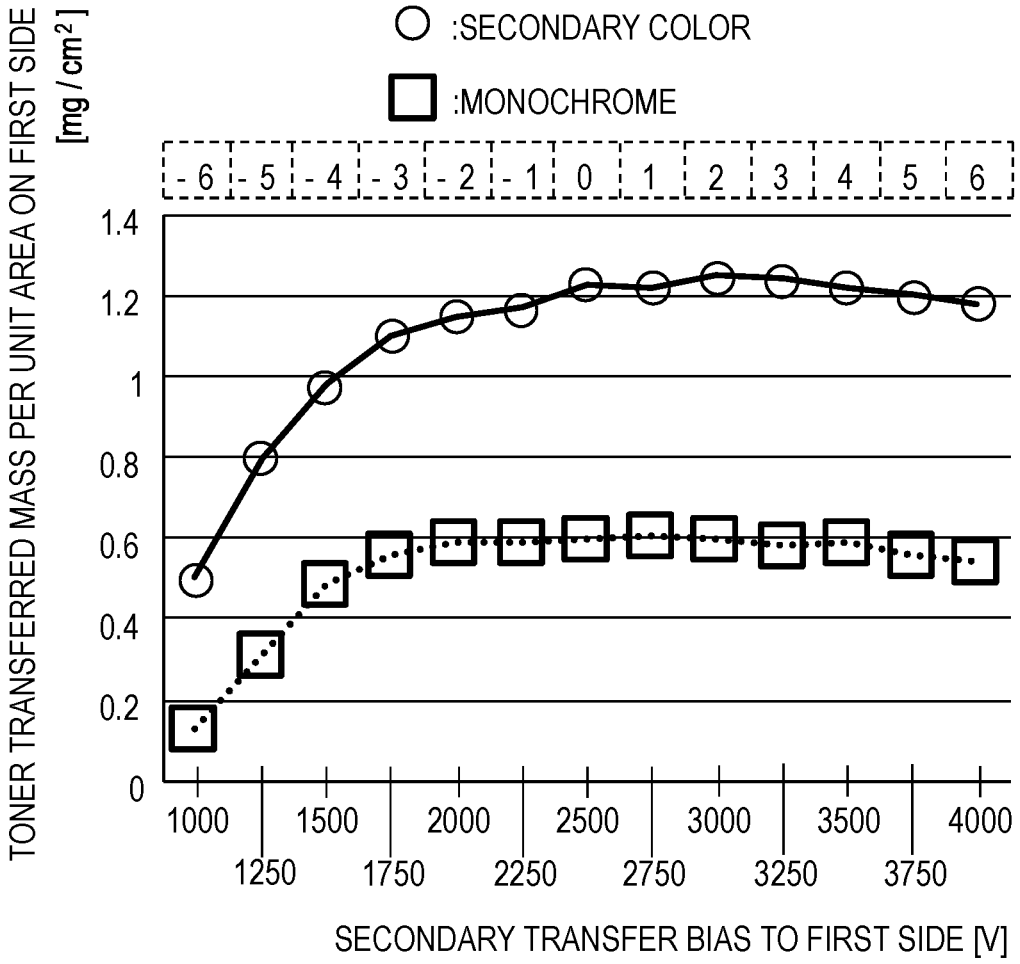
FIG. 3 is a graph illustrating a relationship between a secondary transfer bias of a first side and a toner transferred mass per unit area on the first side in the image forming apparatus according to the first embodiment.

The first test pattern on the first side is formed by changing the setting of the secondary transfer bias in the sheet, so that transferability differs in accordance with the changed transfer setting, and a toner transferred mass per unit area of the test pattern which is formed differs. FIG. 3 illustrates a relationship between the secondary transfer bias which is applied at the time of image formation on the first side, and the toner transferred mass per unit area on the first side. Since transferability changes in accordance with the applied secondary transfer bias, the toner transferred mass per unit area on the sheet also changes in accordance with the transferability. Thereby, on the first side, resistance of toner corresponding to the toner transferred mass per unit area is added to the resistance of the sheet, so that at the time of output of the test pattern on the second side, the test pattern on the second side is formed in a state in which the sheet has a distribution of resistance correspondingly to a difference in the toner transferred mass per unit area on the first side.

Figure 4:
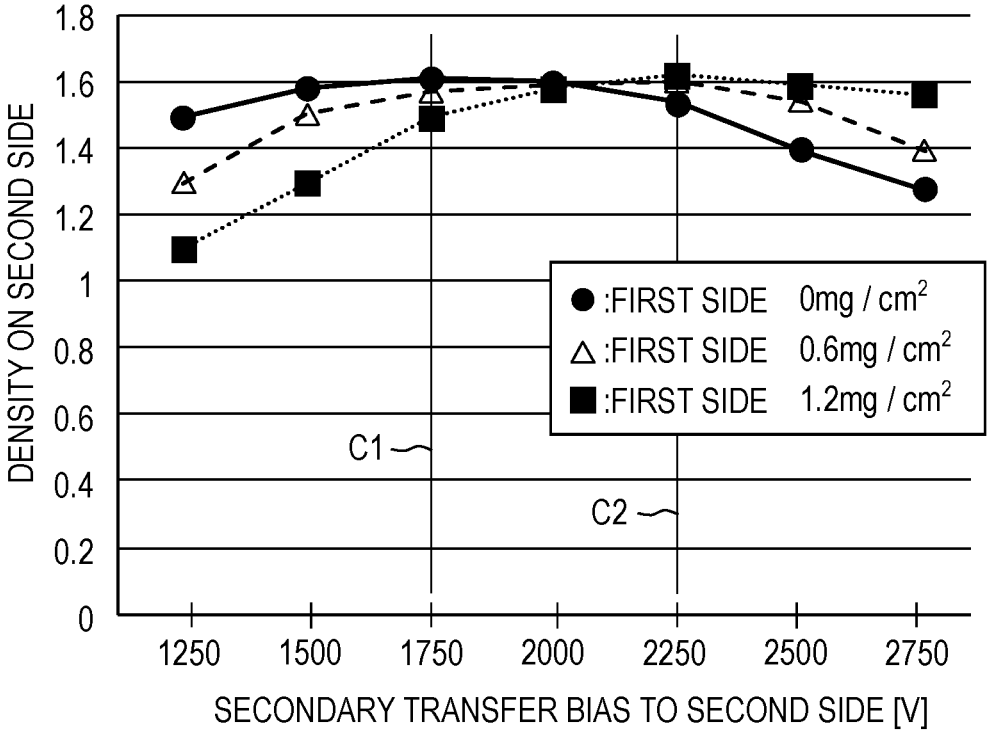
FIG. 4 is a graph illustrating a relationship between a secondary transfer bias of a second side and an image density on the second side in the image forming apparatus according to the first embodiment.

FIG. 4 illustrates a relationship between the secondary transfer bias at the time of image formation on the second side and a toner density of a monochrome solid image on the second side at a time of the toner density on the first side being changed. The image was output in an image forming apparatus (made by Canon Inc., trade name: image RUNNER-ADVANCE C5051) by using Office Planner (made by Canon Marketing Japan Inc., basis weight 64 g/m$^2$) as the sheet. As illustrated in FIG. 4, transferability of the second side changes in accordance with the toner transferred mass per unit area on the first side. For example, when setting of the secondary transfer bias is 2750 V, the toner density is approximately 1.6 when the toner transferred mass per unit area on the first side is 1.2 mg/cm$^2$, and the toner density is approximately 1.4 when the toner transferred mass per unit area on the first side is 0.6 mg/cm$^2$. Accordingly, it is obvious that the toner transferred mass per unit area on the first side has an influence on setting of the transfer condition of the second side.

When the secondary transfer bias adjustment operations of the first side and the second side of the sheet are carried out on the front and back of the same sheet during a series of both-side jobs, a case is conceivable, in which the test pattern on the second side is formed on the back side of the test pattern on the first side with a different toner transferred mass per unit area. In this case, not only a change in the toner transferred mass per unit area by changing the second secondary transfer bias of the second side, but also a change in the toner transferred mass per unit area on the first side influences a detection result, so that precision of transfer setting is reduced. In particular, in the case of a low resistance sheet such as a thin sheet of paper which has a relatively low electric resistance because the sheet absorbs humidity under a high-temperature and high-humidity environment, a ratio of resistance of the toner to the resistance of the sheet is large, so that the detection result is influenced by the toner transferred mass per unit area on the first side more remarkably. Further, transfer setting adjustment is assumed to be carried out by increasing a change range of a set value in order to respond to sheets with various resistances along with recent diversification of media, so that it is feared that the change in the toner transferred mass per unit area on the first side also increases, and precision of adjustment of the second side is further reduced.

In regard to the above, in the present embodiment, in order to reduce the influence of the toner transferred mass per unit area on the first side on the transferability at the time of image formation on the second side, in adjustment control of the secondary transfer bias, the toner transferred mass per unit area on the first side of adjustment control of the secondary transfer bias is made substantially equal. In the present embodiment, when image formation is performed on the first side, when operations of the first secondary transfer bias adjustment of the first side and the second secondary transfer bias adjustment of the second side are independently carried out, and adjustment control of the second secondary transfer bias of the second side is performed, the image forming condition is made constant. Further, when image formation is not performed on the first side when adjustment control of the second secondary transfer bias of the second side is performed, the secondary transfer bias is made constant.

A procedure of adjustment of the secondary transfer bias using the image forming apparatus of the present embodiment will be described along with a flowchart illustrated in FIG. 5, and explanatory views of the respective test charts Tc1 and Tc2 illustrated in FIG. 6 and FIG. 7. First, when a predetermined condition is satisfied, adjustment of the secondary transfer bias is started (step S10), and a test chart output mode is executed. The predetermined condition in this case is assumed to be, for example, a time of turning on the power source of the image forming apparatus 1, after image formation on a plurality of sheets, or an operation of start of adjustment of the operating portion 60 by the user.

Subsequently, the CPU 31 forms a first test pattern 101 composed of a plurality of patch images by the test pattern generation portion, as illustrated in FIG. 6, and outputs the first test pattern 101 to the first side S1 of the first test chart Tc1 in an image formation mode on one side (step S11). The first test pattern 101 is a set of patch images composed of monochrome solid images having respective sizes of 15 mm×15 mm and set at a maximum density. The respective patch images are disposed along a traveling direction of the sheet S with respect to respective colors of a yellow test pattern 101*y*, a magenta test pattern 101*m*, a cyan test pattern 101*c* and a black test pattern 101*k*. Note that in the present embodiment, the respective patch images are solid images, but may be highlight images, or multi-color images without being limited to a maximum density. Further, the image size is not limited to the size and number described above, or the patch images may be output over a plurality of first test charts Tc1.

Here, when the first test pattern 101 is formed, the first secondary transfer bias is changed to as to change the current value which is supplied to the secondary transfer outer roller 45*b* stepwise in accordance with the timing at which the respective patch images are transferred onto the sheet S by the secondary transfer outer roller 45*b*. That is, the controller 30 transfers the first test pattern 101 on the first test chart Tc1 by using a plurality of different first secondary transfer biases, respectively. In the present embodiment, a voltage setting, at which a secondary transfer current of 50 μA flows to the selected sheet S, is calculated by the aforementioned ATVC control, and the first test pattern 101 is output by performing addition or subtraction to ±1500 V every 250 V with Vtr of the calculated result as a center. Further, at the time of output of the first test pattern 101, the controller 30 prints adjustment numbers 101*n* by integers from −6 to +6 onto sides of the patch images in response to a step of voltage setting for output in order to discriminate a level of setting of the first secondary transfer bias.

Figure 8A:
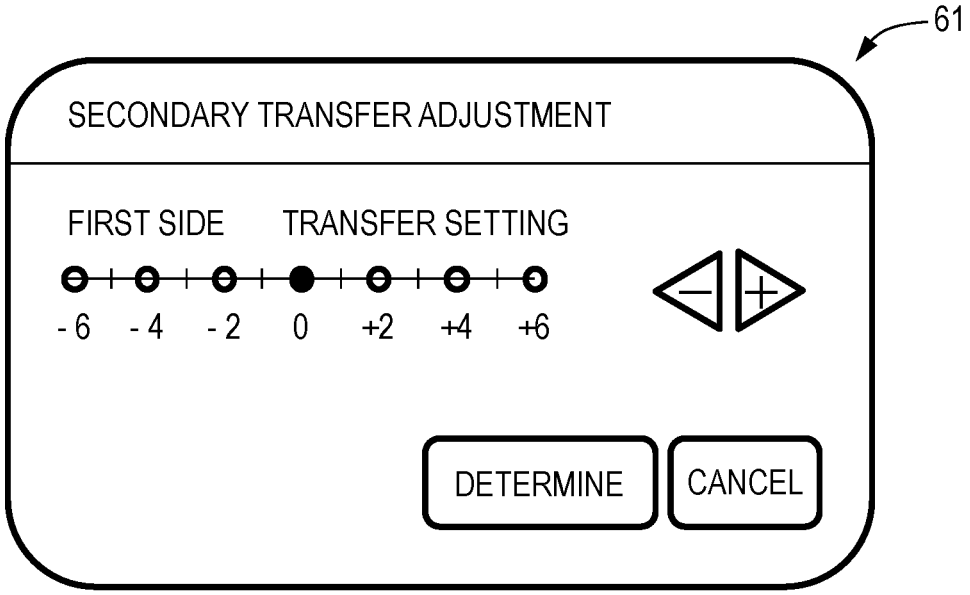
FIG. 8A is a front view illustrating a setting screen of a first secondary transfer bias adjustment of the first side, which is displayed on a display portion of an operating portion in the image forming apparatus according to the first embodiment.

Subsequently, the user refers to the first test pattern 101 which is output to the first side S1 of the first test chart Tc1, and determines necessity of adjustment of the first secondary transfer bias which is applied when an image is formed on the first side at the time of normal image formation (step S12). The adjustment number 101*n* of the density which is most suitable is configured to be able to be selected by the user from the operating portion 60, when it is determined that adjustment of the first secondary transfer bias is necessary by the user (step S13). At this time, as illustrated in FIG. 8A, an optimal setting selection screen of the first secondary transfer bias adjustment of the first side S1 is displayed on a display portion 61 of the operating portion 60, the adjustment number 101*n* is input by the user, and is stored in the ROM 32 (refer to FIG. 2) of the controller 30. The controller 30 sets a first optimal secondary transfer bias of the first side S1 in response to the input adjustment number 101*n*. That is, the controller 30 can set the first secondary transfer bias that is applied to the secondary transfer outer roller 45*b* when transferring the solid image 103 onto the first side of the second test chart Tc2 described later and different from the first test chart Tc1, based on the information input by the user.

Figure 8B:
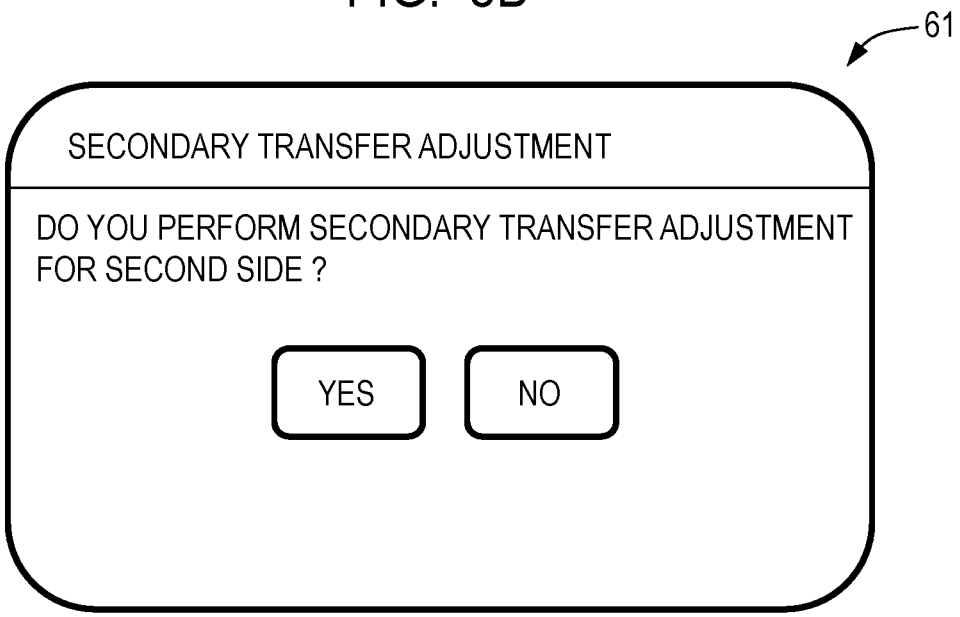
FIG. 8B is a front view illustrating a selection screen of whether or not to execute adjustment of the second side, which is displayed on the display portion of the operating portion in the image forming apparatus according to the first embodiment.

Subsequently, as illustrated in FIG. 8B, whether or not to carry out adjustment of the second secondary transfer bias of the second side S2 subsequently to the first side S1 is displayed on the display portion 61 of the operating portion 60, and the user selects either one (step S14). When the user selects not to carry out adjustment of the second secondary transfer bias of the second side S2, the second secondary transfer bias adjustment is ended (step S19). In this case, it is not necessary to use another sheet S for adjusting the second secondary transfer bias of the second side S2, and the number of sheets S which are consumed can be suppressed. On the other hand, when the user selects to carry out adjustment of the second secondary transfer bias of the second side S2, an adjustment operation of the second secondary transfer bias of the second side S2 is started.

The second test chart Tc2 for performing adjustment of the second secondary transfer bias of the second side S2 is created by using another sheet S of the same kind as the first test chart Tc1 on which the aforementioned first test pattern 101 is formed. Subsequently, to the second test chart Tc2, output is performed in the both-side mode. Subsequently, the first secondary transfer bias set in step S13 is applied to the first side of the second test chart Tc2. Subsequently, in the present embodiment, the solid image 103 as a predetermined toner image is formed as illustrated in FIG. 7 (step S15). The solid image 103 is formed in at least a position overlapping an area where a plurality of toner images of the second test pattern 102 are formed, respectively. The solid image 103 in this case is assumed to be the image that is set in substantially an entire range of the image forming area on the first side of the second test chart Tc2, for example, an entire range of the sheet S except for a blank space in a periphery of the first side with maximum density of a secondary color. By forming the solid image 103 (image of a maximum toner transferred mass per unit area) of the secondary color in a state where transferability is most hard, on the first side, the transfer condition can be set while transferability of the image on the second side S2 is ensured. Further, the solid image 103 is formed on substantially an entire range of the image forming area of the first side of the second test chart Tc2, and the toner transferred mass per unit area is substantially same on the entire surface of the first side. That is, in the solid image 103, the toner transferred masses per unit area of areas overlapping areas where a plurality of toner images are formed of the area on which the solid image 103 is formed are substantially the same, respectively.

Further, the image which is formed on the first side of the second test chart Tc2 is not limited to the solid image 103 of the secondary color, but may be a monochrome solid image or a halftone image. For example, when the solid image 103 which is formed on the first side of the second test chart Tc2 is a solid image of the secondary color, the transfer bias is set by prioritizing transfer efficiency of the secondary color. In this case, when a halftone image is transferred, the secondary transfer bias becomes excessive. Therefore, in the case of a user who forms a halftone image with high frequency, it is more preferable to form a halftone image instead of a solid image of the secondary color as the predetermined toner image which is formed on the first side of the second test chart Tc2, because the transfer condition can be set in a state close to the time of forming a normal image. Therefore, in the present embodiment, density of the predetermined toner image which is formed on the first side of the second test chart Tc2 can be made properly selectable from the operating portion 60. Further, setting at the time of outputting the solid image 103 on the first side of the second test chart Tc2 can be a constant value, but the solid image 103 can be output with more optimized setting by applying the optimal first secondary transfer bias set in step S13. Further, it may be made selectively settable to form no toner image on the first side of the second test chart Tc2.

Subsequently, the CPU 31 forms the second test pattern 102 composed of a plurality of patch images on the second side S2 of the second test chart Tc2 and outputs the second test pattern 102 as illustrated in FIG. 7 by the test pattern generation portion (step S16). The second test pattern 102 is a same pattern as the first test pattern 101, which is formed on the first side S1 of the first test chart Tc1, with respect to a shape and colors. That is, the second test pattern 102 is composed of a plurality of patch images, and the respective patch images form a yellow test pattern 102*y*, a magenta test pattern 102*m*, a cyan test pattern 102*c* and a black test pattern 102*k*. Further, the second test pattern 102 in this case includes patch images as a plurality of toner images that are transferred to the sheet S from the intermediate transfer belt 44*b* respectively by different second secondary transfer biases. By sides of the patch images, adjustment numbers 102*n* by integers from −6 to +6 are printed in correspondence with steps of setting of voltage that is output. That is, the controller 30 outputs the second test chart Tc2 after transferring the first test pattern 101 to the first test chart Tc1 by using a plurality of different first secondary transfer biases, respectively, in the test chart output mode.

Here, the solid image 103 on the first side of the second test chart Tc2 is formed on an entire surface of the sheet S except for a blank space, so that the second test pattern 102 on the second side S2 is disposed to overlap the solid image 103 entirely. Thereby, in the second side S2 of the second test chart Tc2, the second test pattern 102 can be formed in an area where the toner transferred mass per unit area on the first side is substantially same, that is, in the position overlapping the solid image 103 by using a plurality of different second secondary transfer biases.

Figure 9:
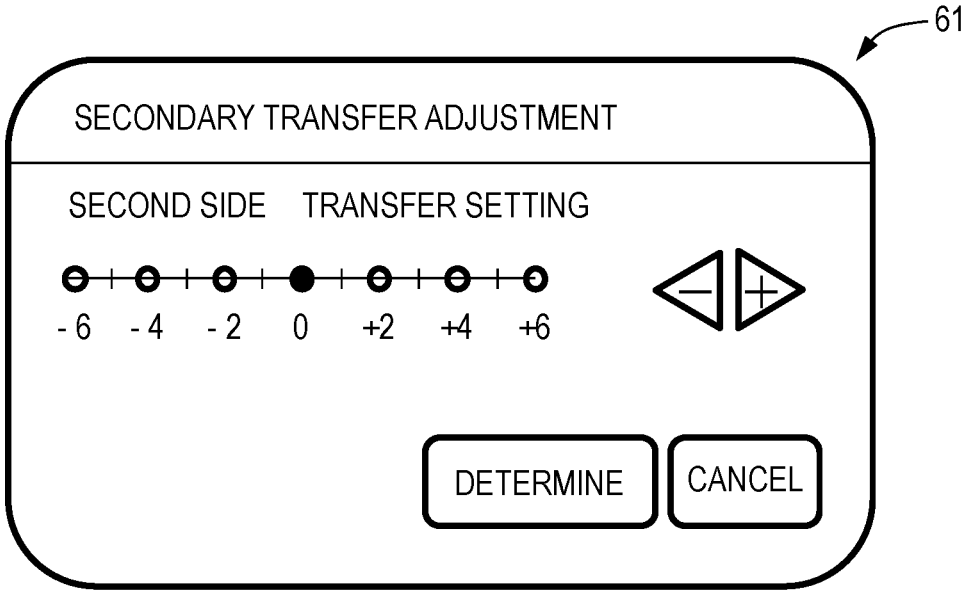
FIG. 9 is a front view illustrating the display portion of the operating portion in the image forming apparatus according to the first embodiment, and is a setting screen of second secondary transfer bias adjustment of the second side.

Subsequently, the user refers to the second test pattern 102 which is output on the second side S2 of the second test chart Tc2, and performs determination about necessity of adjustment of the second secondary transfer bias which is applied when an image is formed on the second side at the time of normal image formation (step S17). When it is determined that adjustment of the second secondary transfer bias is necessary by the user, the adjustment number 102*n* with the most suitable density is configured to be selectable by the user from the operating portion 60 (step S18). At this time, as illustrated in FIG. 9, the optimal setting selection screen of the second secondary transfer bias adjustment of the second side S2 is displayed on the display portion 61 of the operating portion 60, and the adjustment number 102*n* is input by the user, and is stored in the ROM 32 (refer to FIG. 2) of the controller 30. The controller 30 sets the optimal second secondary transfer bias of the second side S2 in response to the input adjustment number 102*n*. Thereafter, the second secondary transfer bias adjustment is ended (step S19).

As described above, according to the image forming apparatus 1 of the present embodiment, the controller 30 forms the second test pattern 102 in the position overlapping the solid image 103 on the first side, on the second side S2 of the second test chart Tc2 by using a plurality of different second secondary transfer biases. Consequently, as compared with the case where the toner image is formed on the first side of the second test chart Tc2 by using a plurality of different first secondary transfer biases, the transfer condition in the second side S2 of the second test chart Tc2 can be set with higher precision. That is, the image density of the solid image 103 and the first secondary transfer bias in the area located on the back side of the second test pattern 102 are made constant. Thereby, the transfer condition of the second test pattern 102 can be set with high precision in the state in which the toner image is formed on the first side while a deviation of the toner transferred mass per unit area in the second test pattern 102 due to a deviation of the toner transferred mass per unit area on the first side is suppressed. That is, the transfer condition of the second side S2 can be adjusted in the state in which the solid image 103 is formed on the first side while precision of setting of the transfer condition of the second side S2 is restrained from being reduced by a density variation of the solid image 103 which is formed on the first side of the second test chart Tc2.

In this way, the controller 30 carries out adjustment operations of the secondary transfer biases on the first side S1 and the second side S2 independently in the control of determining the transfer settings of the first sides S1 and the second sides S2 of the test charts Tc1 and Tc2 based on the detection results of the test patterns 101 and 102. Subsequently, when the toner image is formed on the first side located on the back side of the detection position of the second test pattern 102 on the second side S2, the toner transferred mass per unit area and the first secondary transfer bias are made constant, and thereby the solid image 103 on the first side can be made to have a predetermined substantially equivalent toner transferred mass per unit area. Consequently, determination of the second test pattern 102 on the second side S2 of the second test chart Tc2 can be realized with high precision.

Figure 5:
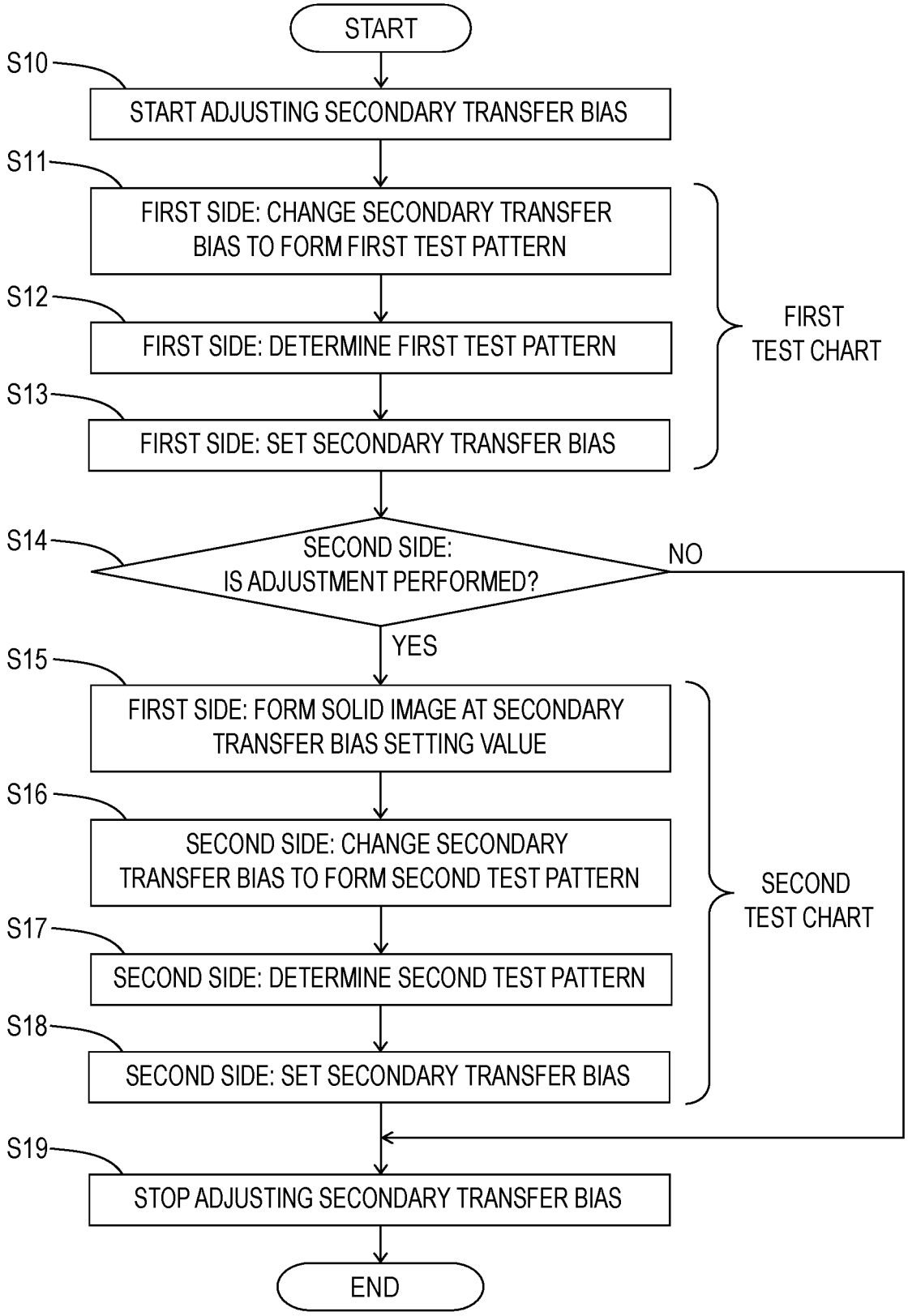
FIG. 5 is a flowchart illustrating an adjustment procedure of the secondary transfer bias in the image forming apparatus according to the first embodiment.

Note that in the image forming apparatus 1 of the present embodiment described above, the first test pattern 101 is determined by the user in step S12 in FIG. 5, but the present invention is not limited to this. For example, a configuration in which the test pattern formed on the sheet S is read by a sensor provided in the image forming apparatus 1 may be adopted. That is, the image forming apparatus 1 is enabled to include a density obtaining portion that obtains a value relating to a density of a read test pattern by reading the first test pattern 101 or the second test pattern 102 formed on the sheet S. In this case, the controller 30 sets an optimal first secondary transfer bias of the first side S1 based on the result obtained by the density obtaining portion, that is, the value relating to the density of the first test pattern 101. Likewise, the controller 30 sets an optimal second secondary transfer bias of the second side S2 based on the result obtained by the density obtaining portion, that is, the value relating to the density of the second test pattern 102. For example, the first test pattern 101 which is output in step S11 is read by using an original reading apparatus 11 as the density obtaining portion, and the optimal first secondary transfer bias of the first side S1 may be set in accordance with a density detection result thereof. Further, the image is read with a sheet patch detecting sensor such as an optical sensor as a density obtaining portion disposed at a downstream side of the fixing portion 46, and the optimal first secondary transfer bias of the first side S1 may be set based on a density detection result thereof.

Further, in the image forming apparatus 1 of the present embodiment described above, the solid image 103 is formed on substantially the entire range of the first side S1 of the sheet S which is the second test chart Tc2 (step S15 in FIG. 5) when adjustment of the second secondary transfer bias of the second side S2 is carried out, but the present invention is not limited to this. For example, in place of the solid image 103 in substantially the entire range, solid images may be formed in a plurality of spots in correspondence with a plurality of toner images of the second test pattern 102 so as to correspond to positions overlapping the second test pattern 102 and not to be formed in a position that does not overlap the second test pattern 102. That is, patch images in which the toner transferred mass per unit area and the first secondary transfer bias are constant may be formed on only the back side of the test pattern formation area of the second side S2 of the second test chart Tc2. In this case, consumption of the toner can be suppressed as compared with the case in which the entire surface of the first test pattern is made the solid image.

Examples

Figure 10:
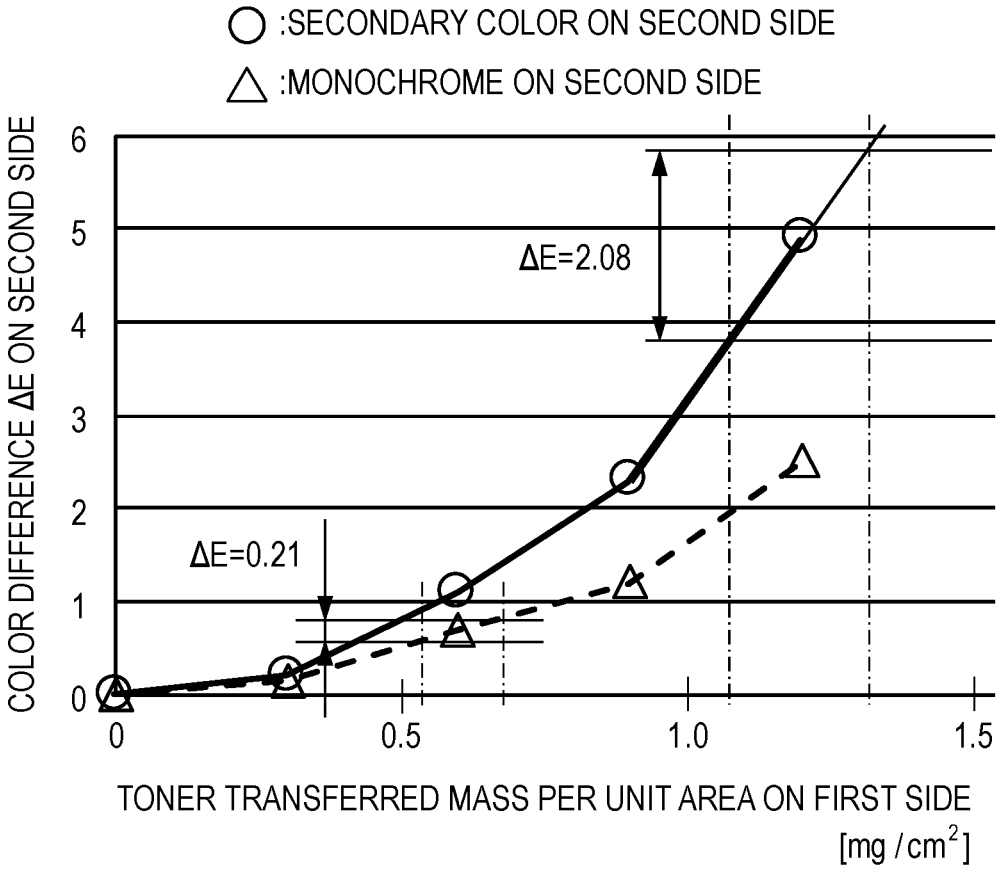
FIG. 10 is a graph illustrating a relationship between a toner transferred mass per unit area on the first side and a color difference of the test pattern on the second side in the image forming apparatus according to the first embodiment.

By using the image forming apparatus 1 of the present embodiment, the solid image was formed on the first side, the patch images were formed on the second side, and a color difference of the patch images was confirmed. As the sheet, Office Planner made by Canon Inc. was used. Note that in the present embodiment, adjustment of the secondary transfer bias is determined based on determination by visual observation by a user, so that a limit of the color difference by which a determination result of different patch images can be determined as equivalent was set as $\Delta E=3.2$. The value is class A tolerance of the color-difference criterion (JIS Z 8721 etc., tolerance of general color sample), and when $\Delta E=3.2$ or less, the color can be determined as an equivalent color, and the color difference does not influence a determination result of the test pattern. FIG. 10 illustrates a relationship between the toner transferred mass per unit area of the solid image on the first side, and the color difference of the patch images formed on the second side.

Example 1

The solid image of the black monochrome image was formed on the first side under the conditions carried out in the present embodiment, and the patch images of the monochrome solid images were formed on the second side. Here, the monochrome solid image on the first side was set to have a maximum toner transferred mass per unit area of 0.6 $mg/cm^2$, and a deviation thereof was set at $\pm 0.06$ $mg/cm^2$, which corresponds to 10%. As a result, as illustrated in FIG. 10, the color difference on the second side was $\Delta E=0.21$, and satisfies $\Delta E=3.2$ or less.

Example 2

As a combination in which a color difference becomes maximum, a solid image of a secondary color image was formed on the first side, and patch images of monochrome solid images were formed on the second side. Here, the maximum toner transferred mass per unit area of the solid image of the secondary color on the first side was set at 1.2 $mg/cm^2$, and a deviation thereof was set at $\pm 0.12$ $mg/cm^2$ which corresponds to 10%. As a result, as illustrated in FIG. 10, the color difference on the second side was $\Delta E=2.08$, and satisfied $\Delta E=3.2$ or less. Accordingly, in both of the case in which the monochrome solid image was formed and the case in which the secondary color solid image was formed on the first side, if the deviation of the toner transfer mass per unit area is 10%, the color difference does not influence the determination result of the test pattern. Here, in the present embodiment, when the deviations of toner masses are within 10%, the toner transferred masses per unit area were regarded as substantially the same. Further, when the deviations of toner transferred masses per unit area were within $\pm 0.15$ $mg/cm^2$, the toner transferred masses per unit area were determined as substantially the same. More preferably, the deviation of the toner transferred mass per unit area is preferably suppressed to be within 5%, and the deviation of the toner transferred mass per unit area is preferably suppressed to be within $\pm 0.10$ $mg/cm^2$. However, it is needless to say that a range in which the toner transferred masses per unit area are substantially the same is not limited to this. Note that when the test chart is determined by the CPU 31 instead of being determined by the user, the range in which the toner transferred masses per unit area are determined as substantially the same does not have to be the entire area overlapping the area where the patch images on the second side are formed. In this case, for example, the toner transferred masses per unit area of at least the area (the area on the first side) overlapping the areas (the determined areas) detected by the density sensor among the patch images on the second side can be made substantially the same.

Further, in each of examples 1 and 2 described above, the first secondary transfer bias at the time of forming the solid image on the first side was made constant, the toner transferred mass per unit area on the sheet of the toner image on the first side was measured a plurality of times, and variation was confirmed. As a result, in example 1, the variation of the toner transferred mass per unit area in the case in which the monochrome solid image was formed was 0.03 mg/cm$^2$, and in example 2, the variation of the toner transferred mass per unit area in the case in which the solid image of the secondary color was formed was 0.05 mg/cm$^2$. Accordingly, the variations of the toner transferred masses per unit area were sufficiently smaller than the deviation of 10% of the toner transferred mass per unit area assumed in examples 1 and 2, so that it was able to be confirmed that the variations do not have a large influence on the detection result of the color difference on the second side.

Second Embodiment

Figure 11:
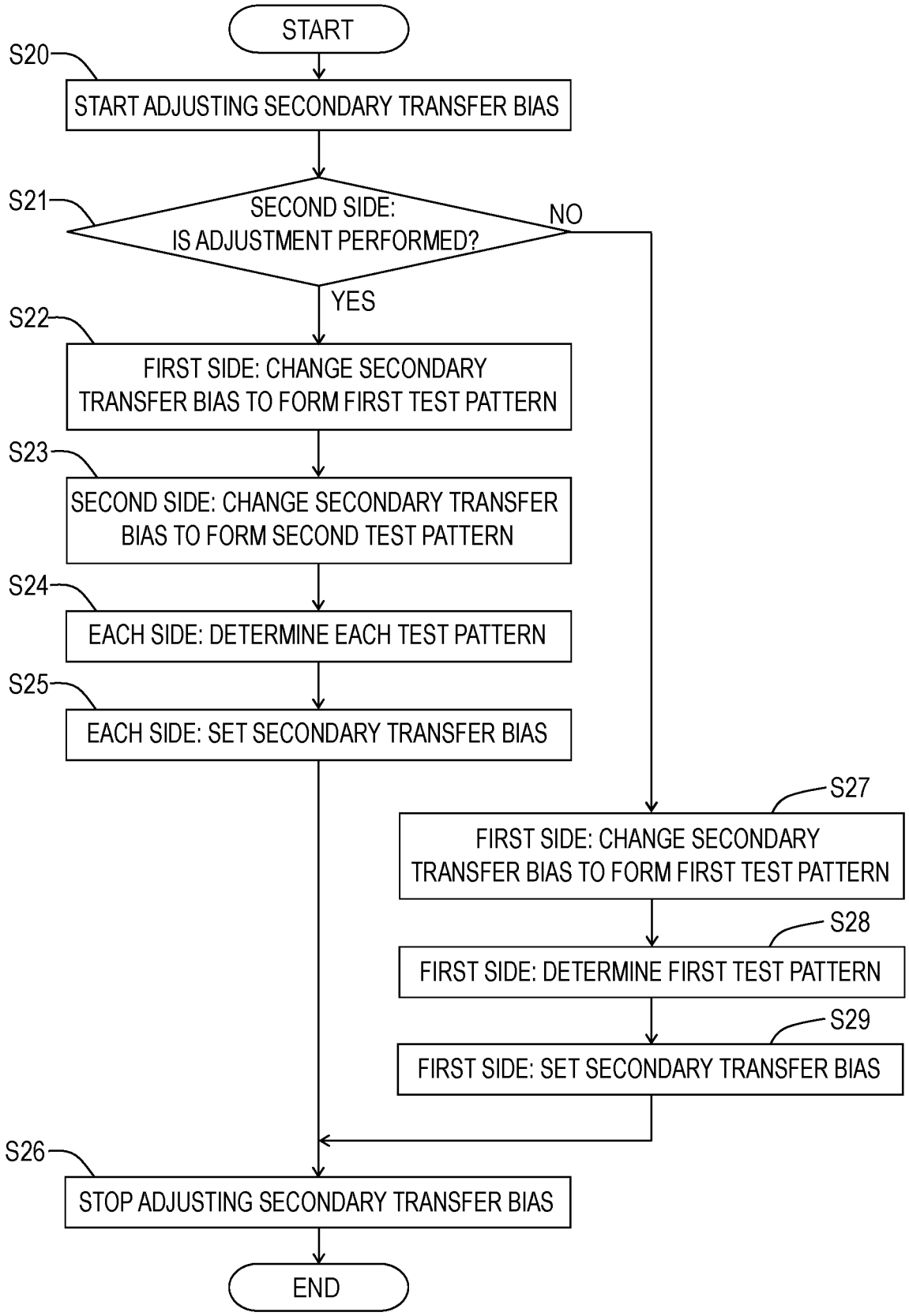
FIG. 11 is a flowchart illustrating an adjustment procedure of a secondary transfer bias in an image forming apparatus according to a second embodiment.
Figure 12A:
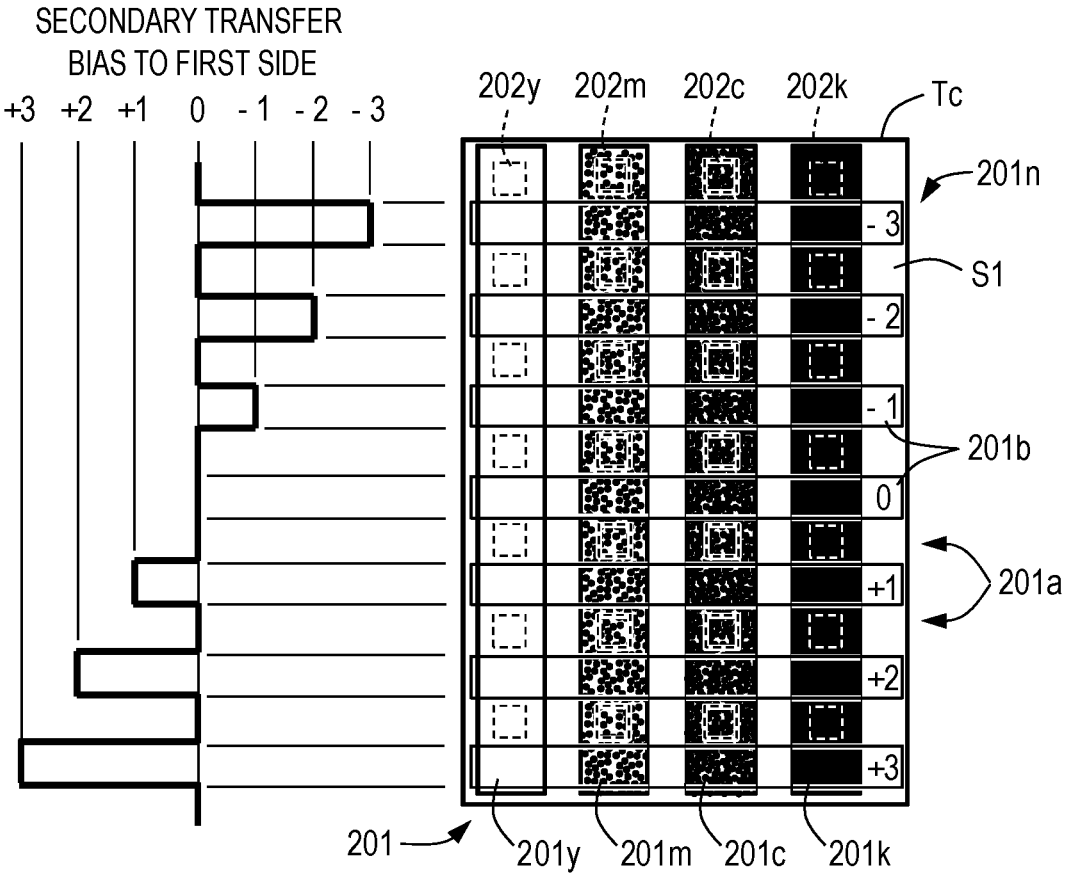
FIG. 12A is an explanatory diagram illustrating a test chart having a first test pattern formed on a first side by the image forming apparatus according to the second embodiment.

Next, a second embodiment of the present invention will be described in detail with reference to FIG. 11, FIG. 12A and FIG. 12B. The present embodiment differs in configuration from the first embodiment, in that a first test pattern 201 formed on the first side S1 of a test chart Tc has a first area 201*a* and a second area 201*b* as illustrated in FIG. 12A. The first area 201*a* is an area in which the toner transferred masses per unit area are substantially same, and the second area 201*b* is an area formed by using a plurality of different transfer voltages. In this case, the controller 30 outputs the first test pattern 201 and the second test pattern 202 to the test chart Tc which is the same sheet S in a test chart output mode. Thereby, an influence of the toner image on the first side S1 is eliminated at a time of adjustment of the second secondary transfer bias on the second side S2, and adjustment of the secondary transfer bias is carried out on the front and back of the same sheet S during a series of both-side jobs. However, the configuration other than the above is similar to the first embodiment, so that the same reference signs will be used and detailed explanation will be omitted.

A procedure of adjustment of the secondary transfer bias using the image forming apparatus 1 of the present embodiment will be described along with the flowchart illustrated in FIG. 11. First, when a predetermined condition is satisfied, adjustment of the secondary transfer bias is started (step S20), and the test chart output mode is executed. The predetermined condition in this case is the time at which the power source of the image forming apparatus is turned on, after formation of a predetermined number of images, or the operation of start of adjustment of the operating portion 60 by the user.

The display portion 61 of the operating portion 60 displays whether to carry out adjustment of the secondary transfer bias of the second side S2 in addition to the first side S1, or whether to carry out adjustment of the secondary transfer bias for only the first side S1, and the user selects either one of them (step S21). When the user selects to carry out adjustment of the secondary transfer bias of the second side S2 in addition to the first side S1, the CPU 31 outputs the sheet S in the image formation mode of both sides. The CPU 31 forms the first test pattern 201 on the first side S1 and outputs the first test pattern 201 as illustrated in FIG. 12A by the test pattern generation portion (step S22). In the first test pattern 201 in this case, solid images of a size of 20 mm×400 mm, which are set at a maximum density of monochrome were disposed with a longitudinal direction along the traveling direction of the sheet S for the respective colors. That is, in the first test pattern 201, the yellow test pattern 201*y*, the magenta test pattern 201*m*, the cyan test pattern 201*c* and the black test pattern 201*k* are disposed side by side in a width direction.

Here, the first test pattern 201 has the first area 201*a* and the second area 201*b*. In the first area 201*a*, the toner transferred masses per unit area are substantially the same, and the first secondary transfer bias is made constant at the time of formation of the first test pattern 201 so as not to influence adjustment of the second side S2. The second area 201*b* is formed by using a plurality of different transfer voltages, and a level of the first secondary transfer bias is varied at the time of formation of the first test pattern 201, for adjustment of the first side S1. The controller 30 controls the first secondary transfer bias so as to form the first area 201*a* and the second area 201*b* alternately at the time of output of the first test pattern 201 to the first side S1. In the present embodiment, the voltage setting with which the secondary transfer current of 50 μA flows, to the selected sheet S is calculated by the aforementioned ATVC control, and output is performed by performing addition and subtraction up to ±1500 V every 500 V with Vtr of a calculation result as a center. Further, by the sides of the patch images, adjustment numbers 201*n* by integers from −3 to +3 are printed in correspondence with steps of setting of a voltage to be output. Note that in the second area 201*b*, a frame line is printed in black so that an image determination area can be discriminated.

Figure 12B:
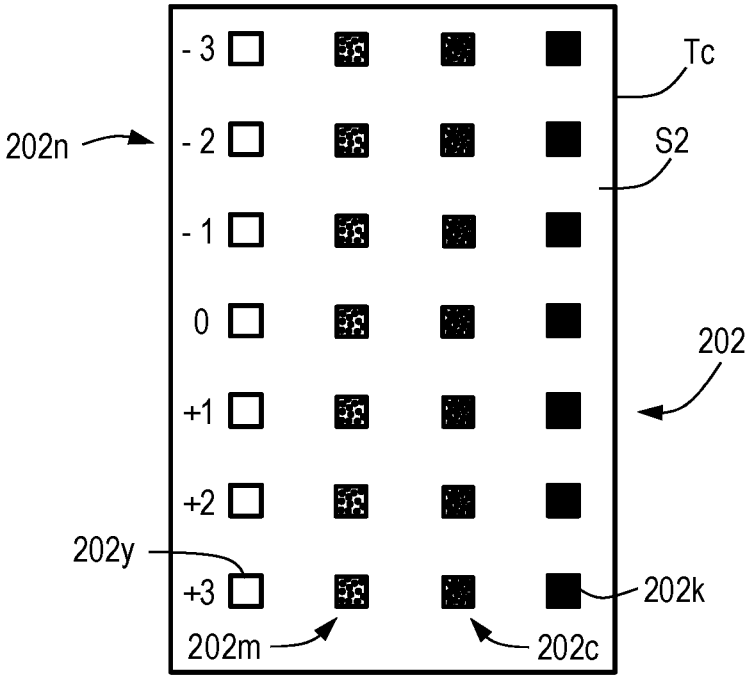
FIG. 12B is an explanatory view illustrating a test chart having a second test pattern formed on a second side by the image forming apparatus according to the second embodiment.

Subsequently, the CPU 31 forms and outputs a second test pattern (a plurality of adjusting toner images) 202 composed of a plurality of patch images onto the second side S2 as illustrated in FIG. 12B by the test pattern generating portion (step S23). The second test pattern 202 is the same pattern as the first test pattern 101 formed on the first side S1 of the first test chart Tc1 of the first embodiment described above, concerning shape and colors. That is, on the second side S2, patch images, each size of which is 15 mm×15 mm, are disposed at intervals of 30 mm along the conveying direction of the test chart Tc to form the second test pattern 202. The respective patch images form yellow test patterns 202*y*, magenta test patterns 202*m*, cyan test patterns 202*c* and black test patterns 202*k*. At this time, on the first side S1 and the second side S2, center positions of the patches of the respective colors are aligned and disposed so as to overlap one another on the front and back.

Further, the second test pattern 202 is formed as follows. That is, the second secondary transfer bias is changed so as to change the current value which is supplied to the secondary transfer outer roller 45*b* stepwise in accordance with the timing at which the respective patch images are transferred to the test chart Tc by the secondary transfer outer roller 45*b*. In the present embodiment, a voltage setting at which the secondary transfer current of 50 μA flows to the selected sheet S is calculated by the aforementioned ATVC control, and output is performed by performing addition and subtraction up to ±1500 V every 500 V with Vtr of a calculation result as the center. Further, the controller 30 prints adjustment numbers 202*n* by integers from −3 to +3 by sides of the patch images, in correspondence with the steps of the voltage settings which are output in order to discriminate the level of setting of the second secondary transfer bias.

Subsequently, the user refers to the first test pattern 201 which is output to the first side S1, and makes a determination about necessity of adjustment of the first secondary transfer bias which is applied when an image is formed on the first side at the time of normal image formation. Further, the user refers to the second test pattern 202 which is output to the second side S2, and makes a determination about necessity of adjustment of the second secondary transfer bias which is applied when an image is formed on the second side at the time of normal image formation (step S24). When it is determined that adjustment of the second secondary transfer bias is necessary by the user, adjustment numbers 201*n* and 202*n* of the most appropriate density are configured to be selectable by the user from the operating portion 60. The controller 30 sets most appropriate secondary transfer biases of the respective sides S1 and S2 in response to the selected adjustment numbers 201*n* and 202*n* (step S25), and the secondary transfer bias adjustment is ended (step S26).

On the other hand, when the user selects to carry out adjustment of the secondary transfer bias for only the first side S1 in step S21, an adjustment operation of the first secondary transfer bias of the first side is started. In the case of adjustment for only the first side, the first test pattern as illustrated in FIG. 12B is formed and output onto the first side S1 in the test pattern generation portion (step S27). Subsequently, determination on an optimal setting is performed with respect to the first secondary transfer bias of the first test pattern which is output to the first side S1 (step S28). As for the optimal setting of the first secondary transfer bias of the first side S1, the user refers to the first test pattern, and user selects the adjustment number of the most appropriate density. The controller 30 sets the optimal first secondary transfer bias of the first side S1 in response to the selected adjustment number (step S29), and secondary transfer bias adjustment is ended (step S26).

As described above, according to the image forming apparatus 1 of the present embodiment, the controller 30 forms the second test pattern 202 on the second side S2 of the test chart Tc by using a plurality of different second secondary transfer biases in positions overlapping the first area 201*a* of the first side S1. Consequently, as compared with the case in which the second test pattern 202 is formed in the positions overlapping the toner images using a plurality of different first secondary transfer biases on the first side S1, the transfer condition in the second side S2 of the test chart Tc can be set with high precision. That is, the image density and the first secondary transfer bias of the predetermined toner images in the area located at the back side of the second test pattern 202 are constant. Thereby, the transfer condition of the second test pattern 202 can be set with high precision in the state where the toner image is formed on the first side S1 while the toner transferred mass per unit area deviation in the second test pattern 202 due to the deviation of the toner transferred mass per unit area on the first side S1 is suppressed. That is, the transfer condition of the second side S2 can be adjusted in the state in which a predetermined toner image is formed on the first side S1 while precision of the transfer condition setting of the second side S2 is restrained from being reduced by the variation in the density of the predetermined toner images formed on the first side S1 of the test chart Tc.

Note that for example, the image forming apparatus 1 may have a configuration in which the test pattern formed on the sheet S is read by a sensor. That is, the image forming apparatus 1 is enabled to include a density obtaining portion that obtains a value concerning a density of a read test pattern by reading the first test pattern 201 or the second test pattern 202 formed on the sheet S. In this case, the controller 30 sets an optimal first secondary transfer bias of the first side S1 based on a result acquired by the density obtaining portion, that is, the value concerning the density of the second area 201*b* of the first test pattern 201. Likewise, the controller 30 sets the optimal second secondary transfer bias of the second side S2 based on the result obtained by the density obtaining portion, that is, the value concerning the density of the second test pattern 202.

Further, if the second area 201*b* for image determination on the first side S1 is sufficiently ensured, and patch images in which the transferred masses per unit area of the toner images are substantially equivalent can be formed on the back side of the patch images on the second side S2, the first test pattern 201 on the first side S1 does not have to be continuous, but may be divided. Further, the size of the patch image can be appropriately set, such as increasing the size by giving priority to ease of recognition by the user, or decreasing the size to increase the change level of the secondary transfer voltage. Further, the number of output sheets S for secondary transfer voltage adjustment may be increased or decreased in accordance with the size of the sheet S, and the size of the patch image.

According to the present embodiment, the image forming apparatus can be provided, which can adjust the transfer condition of the second side in the state in which the toner image is formed on the first side while restraining precision of the transfer condition setting of the second side from being reduced by the density variation of the toner image formed on the first side of the test chart.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-195358, filed Oct. 5, 2017, which is hereby incorporated by reference herein in its entirety.

What is claimed is:

1. An image forming apparatus, comprising:

an image bearing member configured to bear a toner image;

a toner image forming portion configured to form the toner image on the image bearing member;

a transfer device configured to transfer the toner image borne on the image bearing member to a recording material;

a power source configured to apply a transfer voltage to the transfer device; and a controller configured to control a first transfer voltage that is applied to the transfer device when transferring an image to a first side of the recording material and a second transfer voltage that is applied to the transfer device when transferring an image to a second side of the recording material, wherein the controller is configured to control a mode that outputs a test chart on which a test pattern for adjusting the second transfer voltage is formed, wherein the test pattern include a first test image transferred in a state in which a first transfer bias is applied to the transfer device and a second test image transferred in a state in which a second transfer bias different from the first transfer bias is applied to the transfer device, and wherein before the test pattern is formed, a predetermined toner image is transferred to a surface opposite to a surface, on which the test pattern is to be formed, of the test chart, the predetermined toner image being transferred to a first area and a second area, the first area overlapping an area on which the first test image is to be formed and the second area overlapping an area on which the second test image is to be formed, the predetermined toner image being formed on the image bearing member so that an amount of toner formed on the first area is substantially the same as an amount of toner formed on the second area, the predetermined toner image being transferred on the test chart by a same transfer bias.

2. The image forming apparatus according to claim 1, wherein the predetermined toner image is a solid image formed by overlapping different color toners.

3. The image forming apparatus according to claim 1, further comprising an operating portion configured to operate the image forming apparatus, wherein a density of the predetermined toner image is changed by an operation from the operating portion.

4. The image forming apparatus according to claim 1, wherein the controller outputs another test pattern for adjusting the first transfer voltage on a same test chart in the mode.

5. The image forming apparatus according to claim 1, further comprising a density obtaining portion configured to obtain a value concerning a density of the test pattern by reading the test pattern formed on the test chart, wherein the controller sets the second transfer voltage based on a result obtained by the density obtaining portion.

6. The image forming apparatus according to claim 1, wherein the predetermined toner image is a solid image formed on a substantially entire range of the test chart.

7. The image forming apparatus according to claim 1, wherein the predetermined toner image comprises a plurality of patch images, and the plurality of patch images are formed at an interval in a conveying direction.

* * * * *